US007378589B2

(12) United States Patent
Kameda

(10) Patent No.: US 7,378,589 B2
(45) Date of Patent: May 27, 2008

(54) PORTABLE RHYTHM SENSIBLE TOOL

(75) Inventor: Ichiro Kameda, 19-23-910, Utsubohonmachi 1-chome, Nishi-ku, Osaka-shi, Osaka 550-0004 (JP)

(73) Assignee: Ichiro Kameda, Osaka (JP)

( * ) Notice: Subject to any disclaimer, the term of this patent is extended or adjusted under 35 U.S.C. 154(b) by 280 days.

(21) Appl. No.: 11/262,455

(22) Filed: Oct. 28, 2005

(65) Prior Publication Data

US 2006/0201315 A1 Sep. 14, 2006

(30) Foreign Application Priority Data

Mar. 14, 2005 (JP) ..... 2005-001301 U

(51) Int. Cl.
*G10H 3/00* (2006.01)

(52) U.S. Cl. ..... 84/723; 84/730; 84/737; 84/740

(58) Field of Classification Search ..... None
See application file for complete search history.

(56) References Cited

U.S. PATENT DOCUMENTS 4,779,615 A 10/1988 Frazier
2002/0019296 A1* 2/2002 Freeman et al. ..... 482/4
2003/0069470 A1 4/2003 Lee
2004/0093214 A1* 5/2004 Belenger et al. ..... 704/269
2004/0097852 A1 5/2004 Boyd et al.
2006/0070511 A1* 4/2006 Parsons et al. ..... 84/730
2006/0102171 A1* 5/2006 Gavish ..... 128/95.1

FOREIGN PATENT DOCUMENTS

DE 3316100 A1 11/1984
DE 29817780 U1 1/1999
DE 19818943 C1 8/1999
JP 2003265569 A 9/2003

* cited by examiner

*Primary Examiner*—Marion T Fletcher
(74) *Attorney, Agent, or Firm*—Ditthavong Mori & Steiner, P.C.

(57) ABSTRACT

A sound determination unit previously divides sound into a low sound range for first sound, a middle sound range for second sound, and a high sound range for third sound by its frequency band. When sound information detected by the microphone is inputted to the sound determination unit, the sound determination unit determines whether the frequency band of that sound information is in the predetermined low sound range or not. When it is in the low sound range, a signal to operate a first vibrator is generated from a first controller. When it is in the middle sound range, a signal to operate a second vibrator is generated from a second controller. When it is in the high sound range, a signal to operate a third vibrator is generated from a third controller.

15 Claims, 4 Drawing Sheets

PORTABLE RHYTHM SENSIBLE TOOL

BACKGROUND OF THE INVENTION

1. Field of the Invention

The present invention relates to a tool for stimulating a certain part of a human body and more particularly, it relates to a portable rhythm sensible tool through which a user can feel music information and sense its rhythm.

2. Description of the Background Art

Conventionally, a tool to stimulate a certain part of a human body is disclosed in Japanese Unexamined Patent Publication No. 2003-265569 (JP2003-265569), for example. As shown in FIG. 1, a massaging tool 1 disclosed in the JP2003-265569 comprises a vibrator 2 and a sensor 3 which responds to an incoming call of a cellular phone, and the vibrator 2 and the sensor 3 are connected through a connection cable 4.

According to the massaging tool 1, an incoming electric wave of the cellular phone is sensed by the sensor to change over ON/OFF of the vibrator 2.

According to the massaging tool 1 disclosed in the above document, an operation mode of the vibrator 2 can be changed regardless of intention of a user. However, since there are only two modes, that is, a vibrated mode and a non-vibrated mode as its operation mode, the operation mode is poor in variety.

SUMMARY OF THE INVENTION

Thus, it is an object of the present invention to provide a portable rhythm sensible tool in which an operation mode can be arbitrarily and variously changed by an external signal.

A portable rhythm sensible tool according to the present invention comprises a touch part to be attached onto a certain part of a human body, a first vibrator arranged in the touch part, a second vibrator arranged at a part different from that of the first vibrator in the touch part, information collecting means for collecting different kinds of information, information determining means for determining the kind of information collected by the information collecting means, and vibration controlling means comprising a first controller generating a signal to operate the first vibrator when first information is detected by the information determining means, and a second controller generating a signal to operate the second vibrator when second information which is different from the first information is detected by the information determining means.

In the above constitution, since a variety of vibration modes can be implemented regardless of intention of a user, the user can feel rhythm and pleasure which is rich in variety.

The information determining means is sound determining means for determining sound having different frequency bands, the first information is sound in a low frequency band, and the second information is sound in a high frequency band, for example. In addition, the information determining means may be sound determining means for determining strength of sound, and the first information may be weak sound and the second information may be strong sound. Thus, when music is inputted, for example, the portable rhythm sensible tool can implement various vibration modes by a sound range or tempo of the music.

Furthermore, the information determining means may be bit data determining means for determining bit data and the first and second information may be predetermined bit rows.

Thus, information such as music can be directly inputted from a personal computer, a television or various kinds of cellular terminals.

Preferably, the first and second vibrators may be different in vibration mode. In addition, preferably, vibration controlling means arbitrarily varies vibration modes of the first vibrator and the second vibrator by the kind of information determined by the information determining means. For example, the vibration mode is strength of the vibration and/or frequency of the vibration.

Thus, there can be provided the portable rhythm sensible tool which can implement various vibration modes regardless of the intention of the user by using vibrators having different vibration strength or vibration frequency from each other as the first and second vibrators incorporated in the touch part, or by arbitrarily controlling the vibration strength and/or vibration frequency of each vibrator with the vibration controlling means.

As a result, the above portable rhythm sensible tool can be used when the user enjoys music to feel more great pleasure.

Since the present invention implements a variety of rhythm vibration modes for the certain part of the human body regardless of the intention of the user, there can be provided the portable rhythm sensible tool which can provide a variety of feelings of rhythm and pleasure.

DESCRIPTION OF THE PREFERRED EMBODIMENTS

A sound sensing type of portable rhythm sensible tool according to one embodiment of the present invention will be described with reference to FIGS. 2 and 3.

Figure 1:
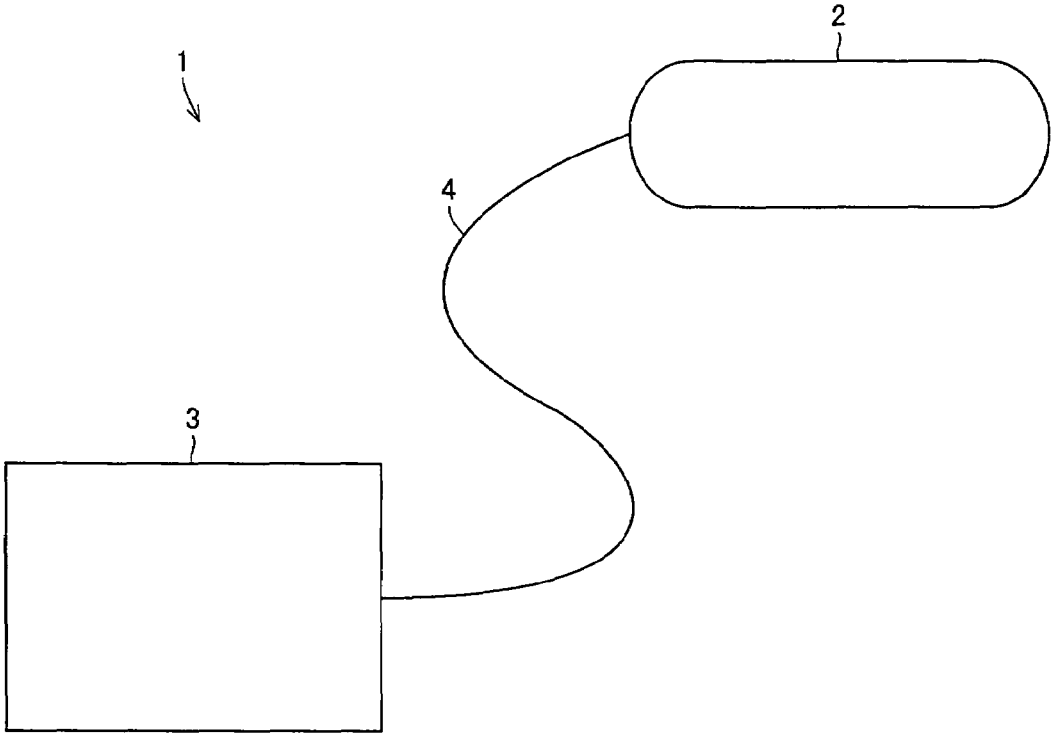
FIG.1 PRIOR ART
FIG. 1 is a schematic view showing a conventional portable rhythm sensible tool.
Figure 2:
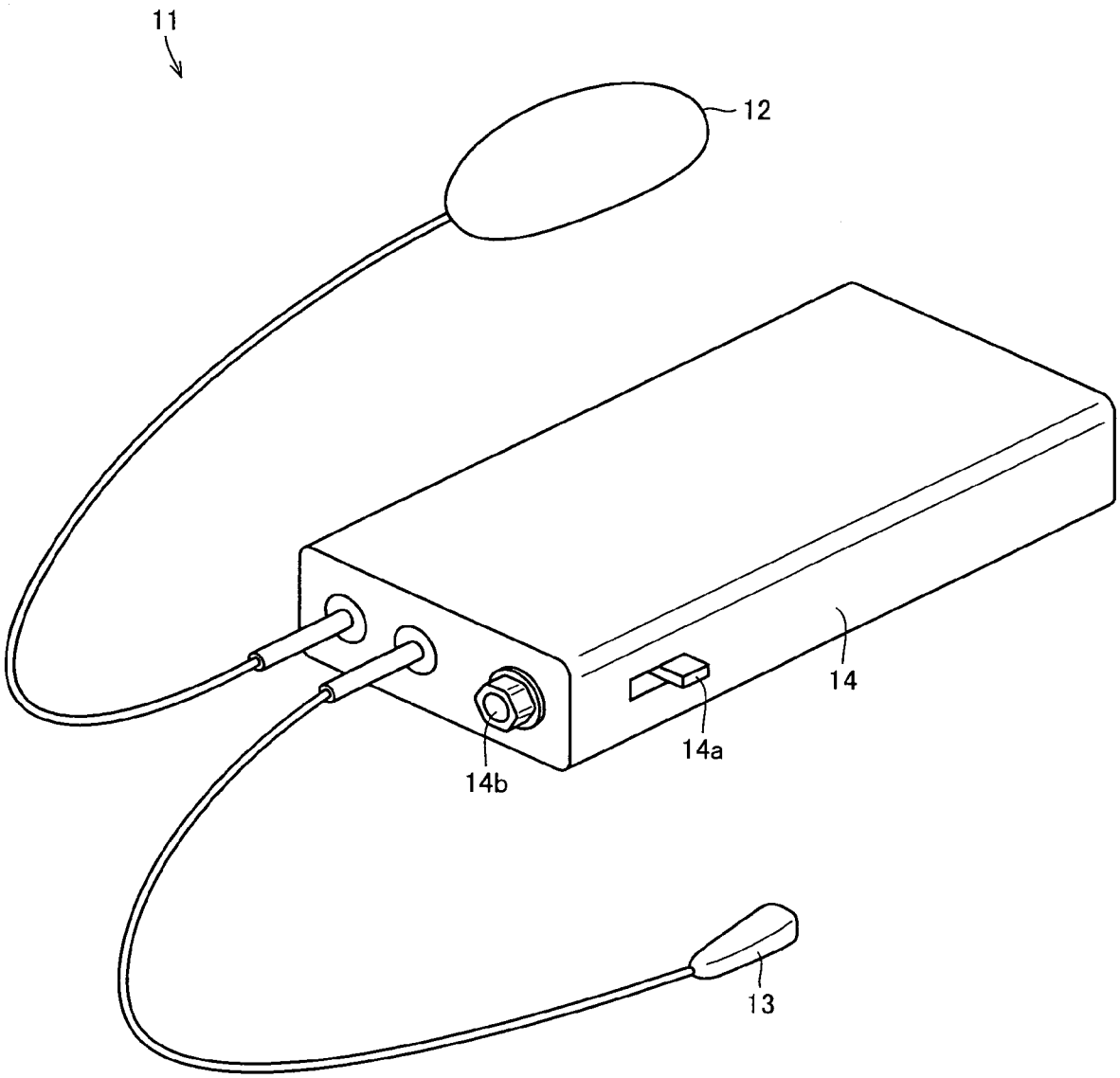
FIG. 2 is a portable rhythm sensible tool according to one embodiment of the present invention.
Figure 3:
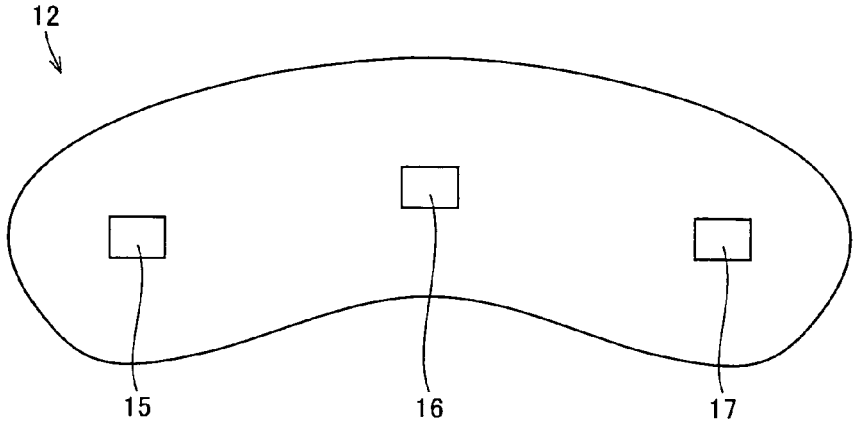
FIG. 3 is an enlarged sectional view showing a touch part in FIG. 2.

As shown in FIG. 2 and 3, a portable rhythm sensible tool 11 comprises a touch part 12 to be attached to a certain part of a human body and a microphone 13 serving as information collecting means for collecting different kinds of sound, and a body 14 comprising a vibration control unit (not shown) serving as vibration controlling means and having a portable size. In addition, a main power supply switch 14*a* and an adjustment knob 14*b* to adjust a degree of vibration of the touch part 12 are provided on the body 14.

In addition, FIG. 3 is an enlarged sectional view showing the touch part 12. The touch part 12 incorporates a first vibrator 15, a second vibrator 16, and a third vibrator 17 which are shifted in position in the longitudinal direction and serve as vibration generating means.

The vibration control unit comprises a sound determination unit serving as information determining means for determining the kind of sound inputted from the microphone, and first to third controllers (not shown) to generate signals to operate the vibrators 15, 16 and 17 according to a range of the sound detected by the sound determination unit.

Figure 4:
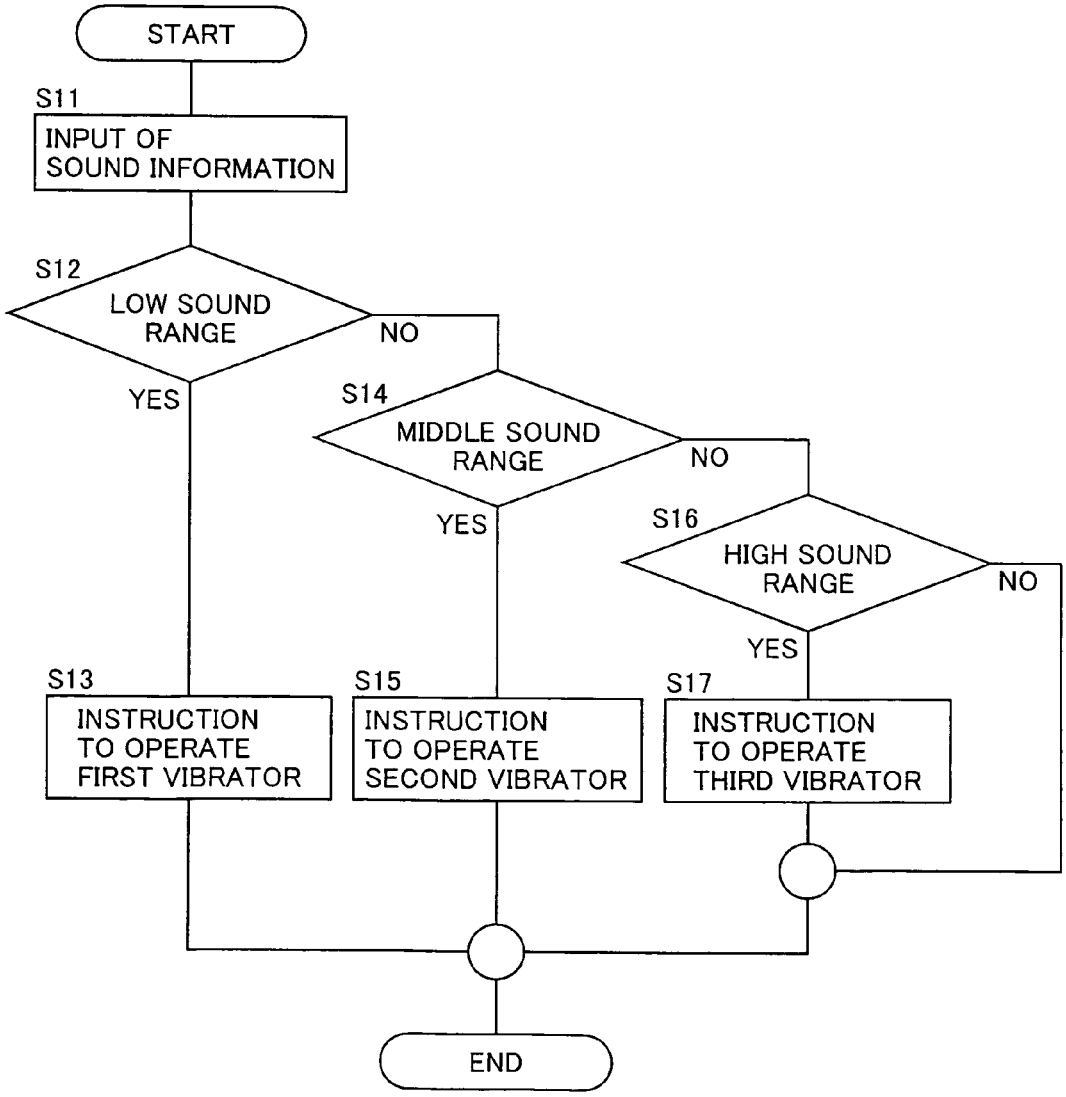
FIG. 4 is a flow chart showing an operation of the portable rhythm sensible tool according to one embodiment of the present invention.

For example, an example of an operation of the portable rhythm sensible tool 11 shown in FIG. 2 will be described with reference to FIG. 4.

The sound determination unit previously divides sound into a low sound range for first sound, a middle sound range for second sound, and a high sound range for third sound by its frequency band. When sound information detected by the microphone 13 is inputted to the sound determination unit at step S11 (the term "step" will be omitted hereinafter), the sound determination unit determines whether the frequency band of that sound information is in the predetermined low sound range or not at S12. When it is in the low sound range (Yes at S12), a signal to operate the first vibrator 15 is generated from the first controller at S13.

When the inputted sound information is not in the low sound range (No at S12), the sound determination unit determines whether it is in the middle sound range or not at S14. When it is in the middle sound range (Yes at S14), a signal to operate the second vibrator is generated from the second controller S15.

Similarly, when the inputted sound information is not in the middle sound range (No at S14), the sound determination unit determines whether it is in the high sound range or not and when it is (Yes at S16), a signal to operate the third vibrator is generated from the third controller at S17.

Meanwhile, when the inputted sound information is not in any one of the low, middle and high sound ranges, that is, when it has a frequency lower than that of the low sound range or it has a frequency higher than that of the high sound range (No at S16), the vibrators 15, 16 and 17 are not operated and the process is completed.

According to the above constitution, since the touch part 12 can be operated in a variety of operation modes regardless of intention of the user, the user can feel unpredictable rhythm and pleasure. In addition, it is preferable that music to which each sound range can be inputted so as to be superimposed and the like is used as the inputted information. Thus, the touch part 12 can be operated in a more variety of modes by the sound range and tempo of the music.

For example, in the case the portable rhythm sensible tool having the above constitution is used to stimulate the pubic area of a woman, when pleasant music is set at first and rhythmical music is gradually replaced with the pleasant music, its vibration can stimulate the user according to an elevated feeling of the user. As a result, the user can feel more impressed pleasure.

Although only the vibrations of the vibrators 15, 16 and 17 are controlled in the above embodiment, the present invention is not limited to this. For example, strength and/or frequency of the vibrations of the vibrators 15, 16 and 17 may be controlled. Furthermore, these components may be mixed and controlled.

In addition, although a lower limit of the low sound range and an upper limit of the high sound range are provided in the above embodiment, the present invention is not limited to this. For example, all frequency bands may be divided into any region. Furthermore, although the frequency bands are divided into three kinds of low, middle and high sound ranges in the above embodiment, it may be divided into any number of regions.

Furthermore, although the sound collecting means is used as the information collecting means and the vibration of the vibrator is controlled by the collected sound frequency in the above embodiment, the present invention is not limited to this. For example, the vibrator may be controlled by strength of the collected sound.

Figure 5:
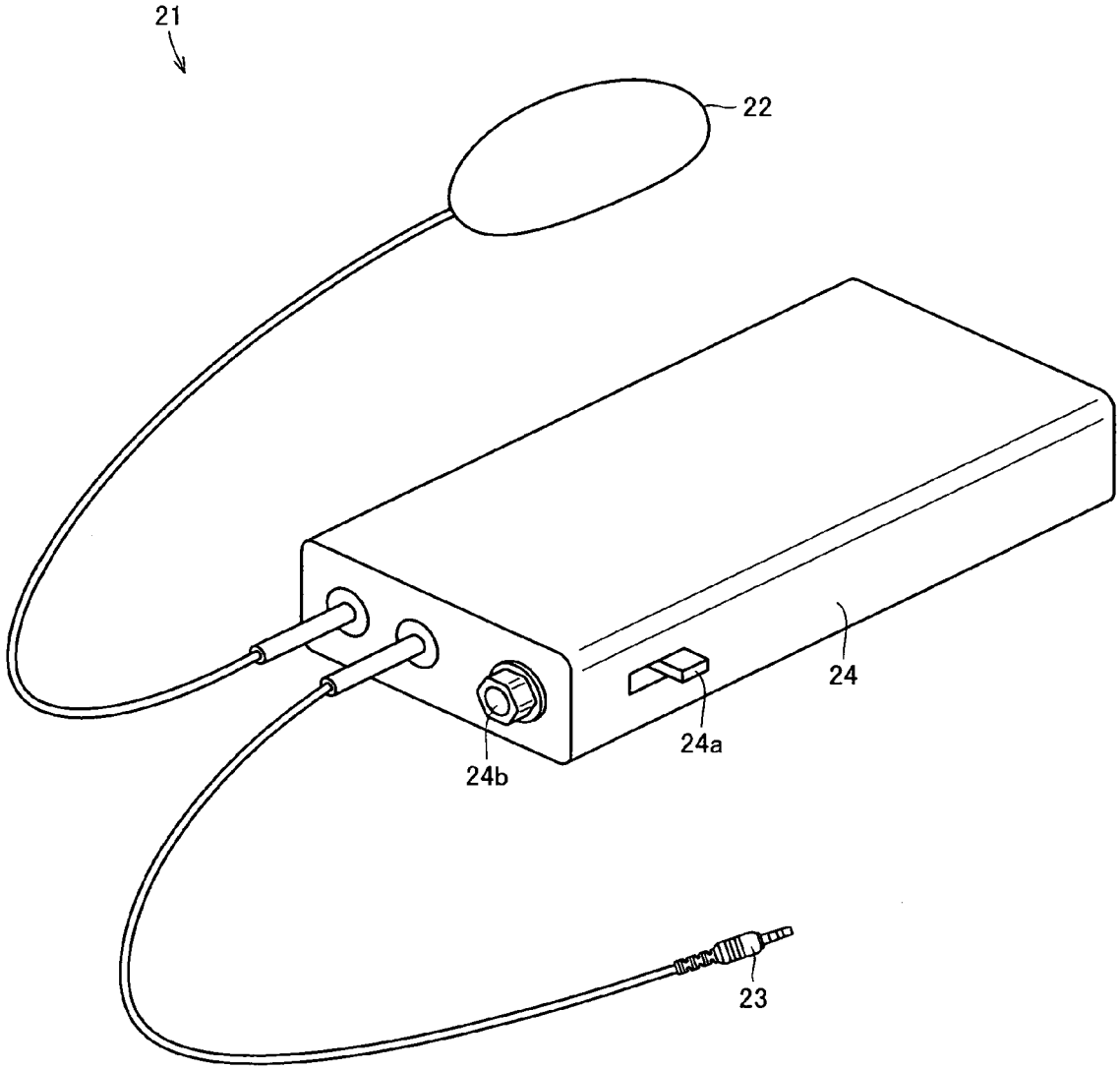
FIG. 5 is a portable rhythm sensible tool according to another embodiment of the present invention.

Alternatively, another information collecting means may be used. For example, as shown in FIG. 5, an input terminal 23 may be provided in the same constitution as that of the portable rhythm sensible tool 21 instead of the microphone 13. Thus, digital information such as music information may be directly inputted from a personal computer, a television or various kinds of cellular information terminals to control the vibration of the vibrator.

In this case, the information determining means is bit data determining means for determining bit data, and a variety of controls of the vibrator can be implemented depending on a predetermined bit row.

Although the above portable rhythm sensible tool 11 may be used as a portable rhythm sensible tool for stimulating the woman pubic area, the present invention is not limited to this. For example, it may be used as a portable rhythm sensible tool for stimulating the prostate gland, so that it can be used for both men and women.

Although the embodiments of the present invention have been described with reference to the drawings in the above, the present invention is not limited to the above illustrated embodiments. Various kinds of modifications and variations may be added to the illustrated embodiments within the same or equal scope of the present invention As described above, the portable rhythm sensible tool can be advantageously used as an entertainment portable rhythm sensible tool

What is claimed is:

1. A portable stimulating tool comprising:

a case to be touched onto a certain part of a human body;

a first vibrator arranged in said case;

a second vibrator arranged at a part different from that of said first vibrator in said case;

a third vibrator arranged in said case apart from said first and second vibrators;

sound collecting means for collecting sounds having different frequency zones;

sound determining means for determining a zone of frequencies collected by the sound collecting means; and vibration controlling means comprising a first controller to operate said first vibrator in response to sounds in a first frequency zone detected by said sound determining means, a second controller to operate said second vibrator in response to sounds in a second frequency zone higher than said first frequency zone detected by said sound determining means and a third controller to operate said third vibrator in response to sounds in a third frequency zone higher than said second frequency zone detected by said sound determining means.

2. The portable stimulating tool according to claim 1, wherein said first vibrator is operable in a first vibration action, said second vibrator is operable in a second vibration action different from said first vibration action, and said third vibrator is operable in a third vibration action different from said first and second vibration actions.

3. A portable rhythm sensible tool comprising:

a case configured to be provided on a part of a human body;

a first vibrator housed within a first part of said case;

a second vibrator housed within a second part of said case;

a third vibrator housed within a third part of said case;

a sound collecting device configured to collect sounds;

a sound determination unit configured to determine ranges of sounds collected by said sound collecting device; and a control device configured to operate said first vibrator in response to sounds determined by said sound determination unit to be in a first sound range, said control device is configured to operate said second vibrator in response to sounds determined by said sound determination unit to be in a second sound range, and said control device is configured to operate said third vibrator in response to sounds determined by said sound determination unit to be in a third sound range, wherein said first sound range is different from said second sound range, and wherein said third sound range is different from said first sound range and from said second sound range.

4. The portable rhythm sensible tool according to claim 3, wherein said first sound range is a low frequency band, wherein said second sound range is a middle frequency band, and wherein said third sound range is a high frequency band.

5. The portable rhythm sensible tool according to claim 3, wherein said first sound range is a first tempo, wherein said second sound range is a second tempo, and wherein said third sound range is a third tempo.

6. The portable rhythm sensible tool according to claim 3, wherein said first sound range is a first sound strength range, wherein said second sound range is a second sound strength range, and wherein said third sound range is a third sound strength range.

7. The portable rhythm sensible tool according to claim 3, wherein said first, second, and third vibrators have different vibration modes.

8. The portable rhythm sensible tool according to claim 7, wherein said control device varies vibration modes of said first, second, and/or third vibrators in response to sounds determined by said sound determination unit.

9. The portable rhythm sensible tool according to claim 8, wherein said control device arbitrarily varies said vibration modes of said first, second, and/or third vibrators in response to sounds determined by said sound determination unit.

10. The portable rhythm sensible tool according to claim 7, wherein said different vibration modes include different strengths of vibration and/or different frequencies of vibration.

11. A portable rhythm sensible tool comprising:

a case configured to be provided on a part of a human body;

a first vibrator housed within a first part of said case;

a second vibrator housed within a second part of said case;

a third vibrator housed within a third part of said case;

a data collecting device configured to collect bit data;

a determination unit configured to determine bit rows of bit data collected by said data collecting device; and a control device configured to operate said first vibrator in response to bit rows determined by said determination unit to be a first predetermined bit row, said control device is configured to operate said second vibrator in response to bit rows determined by said determination unit to be a second predetermined bit row, and said control device is configured to operate said third vibrator in response to bit rows determined by said determination unit to be a third predetermined bit row.

12. The portable rhythm sensible tool according to claim 11, wherein said first, second, and third vibrators have different vibration modes.

13. The portable rhythm sensible tool according to claim 12, wherein said control device varies vibration modes of said first, second, and/or third vibrators in response to bit rows determined by said determination unit.

14. The portable rhythm sensible tool according to claim 13, wherein said control device arbitrarily varies said vibration modes of said first, second, and/or third vibrators in response to bit rows determined by said determination unit.

15. The portable rhythm sensible tool according to claim 12, wherein said different vibration modes include different strengths of vibration and/or different frequencies of vibration.

* * * * *